US005261850A

United States Patent [19]

Barthold

[11] Patent Number: 5,261,850

[45] Date of Patent: Nov. 16, 1993

[54] ELASTIC MATERIAL INFLATION TOY

[75] Inventor: Mark J. Barthold, Redondo Beach, Calif.

[73] Assignee: Mattel, Inc., El Segundo, Calif.

[21] Appl. No.: 805,289

[22] Filed: Dec. 10, 1991

[51] Int. Cl.[5] ..... A63H 33/40; A63H 29/10

[52] U.S. Cl. ..... 446/180; 446/197

[58] Field of Search ..... 446/176, 180, 181, 182, 446/193, 197, 198, 220, 222, 224

[56] References Cited

U.S. PATENT DOCUMENTS

| | | | |
|---|---|---|---|
| D. 198,857 | 8/1964 | Rabin . | |
| 1,057,596 | 4/1913 | Teuscher | 446/181 |
| 1,315,851 | 9/1919 | Mispel | 446/181 |
| 2,031,785 | 2/1936 | North et al. | 446/181 |
| 2,351,823 | 6/1944 | Lefever | 446/181 |
| 2,776,530 | 1/1957 | Baumgardner . | |
| 2,912,791 | 11/1959 | Cohen . | |
| 3,469,340 | 9/1969 | Breneman et al. | 446/197 |
| 4,149,338 | 4/1979 | Wolf | 446/197 X |
| 4,276,713 | 7/1981 | Crosbie . | |
| 4,551,109 | 11/1985 | Hanson | 446/465 X |
| 4,568,302 | 2/1986 | Henderson | 446/197 X |
| 4,988,319 | 1/1991 | Shen . | |

FOREIGN PATENT DOCUMENTS

| | | | |
|---|---|---|---|
| 2012601 | 8/1979 | United Kingdom | 446/193 |

*Primary Examiner*—Robert A. Hafer
*Assistant Examiner*—D. Neal Muir
*Attorney, Agent, or Firm*—Roy A. Ekstrand

[57] ABSTRACT

An elastic material inflation toy includes an elongated base and a generally spherical housing. The elongated base supports a collapsible air bellows and a pair of one-way check valves which cooperate with the air bellows to produce a stream of pressurized air as the air bellows are operated. An inflation tube is coupled between the air bellows pressure output and the spherical housing. The spherical housing defines an annular collar which receives a pancake-like shape quantity of elastic material. A pivotally secured annular lock ring includes a lock clasp for securing the lock ring upon the elastic material in a sealing attachment whereby the elastic material forms a generally air-tight seal against the spherical housing collar. As the air bellows are operated, the pressure within the spherical housing inflates the portion of the elastic material spanning the collar into a spherical expansion similar to a bubble. The inflation process may be continued until the spherical expansion of elastic material bursts.

12 Claims, 2 Drawing Sheets

10
64
39
16
17
20
23
30
18
19
15
13
22
14
21
37
83
31
82
90
38
71
70
60
62
61
63
44
46
46
81
52
50
51
55
27
80
53
54
11
12
24
35
36

ELASTIC MATERIAL INFLATION TOY

FIELD OF THE INVENTION

This invention relates generally to inflatable toys and particularly to inflating mechanisms used in combination therewith.

BACKGROUND OF THE INVENTION

Many types of inflation toys and inflators for use in combination therewith have been created through the years. Often a balloon or similar elastic object is inflated by a simplified inflation mechanism such as an expandable bellows or the like. Great excitement is provided by such toys as children pump up or otherwise inflate an expanding balloon or similar object and watch it grow. In some toys, an associated game is played in combination with the inflation process. In others, the excitement may culminate in the inflation of the resilient object to a point where it bursts adding increased drama to the game or toy.

U.S. Pat. No. 4,149,338 issued to Wolf sets forth a CHILD'S TOY AND GAME in which a housing depicts a landscape portion having a large upwardly facing simulated flower having a flared bell-shaped portion defined therein. A collapsible air bellows to a nozzle supported within the bell-shaped portion of the flower. Appropriate check valves are provided to facilitate the creation of a stream of pressurized air outwardly through the nozzle as the bellows are successively depressed and released. An inflatable balloon having a nozzle portion supporting a resilient plug therein which in turn defines a center passage for communication to the balloon interior is resiliently coupled to the flower nozzle. Thereafter, as the bellows is successively depressed and released, pressurized air is forced into the balloon causing it to inflate. As the balloon is inflated and expands, its outer surface is forced against the bell-shaped portion of the simulated flower producing a drawing force upon the resiliently supported balloon nozzle. At some point, this force exceeds the resilient retaining force upon the balloon and the balloon is ejected from the flower and is thereafter propelled by the air being expelled through the balloon nozzle.

U.S. Pat. No. 4,276,713 issued to Crosbie sets forth a PERCOLATING BUBBLE GENERATOR in which a stream of air is utilized to form a succession of bubbles and launch them into the air. A pistol grip type housing includes a pivotally movable hand grip lever and an internally supported collapsible air bellows. The movable lever is coupled to and operates the collapsible bellows as the pivotal lever is gripped and released. A nozzle at the output of the collapsible bellows provides an airstream which is directed toward a bubble producing liquid supported downstream within the pistol grip shaped housing.

U.S. Pat. No. 4,568,302 issued to Henderson sets forth a MANUALLY ACTUATABLE AERATING DEVICE FOR DOLL'S SPA in which a small water reservoir replicates a miniaturized spa and supports a quantity of water. A multiapertured aerating tube is supported at the lower surface of the water reservoir and is coupled to an expandable air bellows. The coupling between the aerating pipe and the expandable air bellows includes an expandable bladder and one way valve. The expandable bladder provides a smoothing effect between the air pressure surges produced by the repeated compression and release of the air bellows and thereby produces a more gradual steady stream of aerating bubbles within the simulated spa.

U.S. Pat. No. 4,988,319 issued to Shen sets forth a BUBBLE BLOWER which includes a tube having an input end for air and an output end. A first nozzle is connected to the output end while a second concentric nozzle is mounted surrounding the first nozzle. A squeezable reservoir is coupled to the nozzles and is operative when squeezed to fill the space between the nozzle with a bubble producing liquid. Thereafter, bubbles are produced by blowing air through the open end of the tube.

U.S. Patent Des. 198,857 issued to Rabin sets forth a BUBBLE BLOWING TOY having a collapsible reservoir for bubble material together with an upwardly extending discharge tube. The latter terminates in a bubble blowing ring. A fanciful toy figure is supported upon the discharge tube which terminates in an upwardly extending nozzle.

U.S. Pat. No. 2,776,530 issued to Baumgardner sets forth a FIGURE WITH BALLOON INFLATING MEANS in which a housing supports a reservoir of pressurized gas within its interior. The housing is formed in a fanciful clown's face and includes an outwardly extending nozzle tip near the mouth portion thereof. A tube is coupled between the nozzle and the source of pressurized gas. The nozzle is adapted to receive the inflation nozzle of a balloon or the like. The source of pressurized gas includes an air pump having an actuated rod extending upwardly therefrom which in turn supports a generally spherical knob.

U.S. Pat. No. 2,912,791 issued to Cohen sets forth a TOY in which a housing defines an interior cavity having an outwardly extending nozzle passage at one end thereof. The nozzle passage terminates within an extending nozzle which receives an inflatable member such as a balloon or the like. A collapsible bladder is supported within the interior cavity and accommodates a pair of check valves at each end thereof. A movable plunger is supported by the housing and extends into the interior cavity resting against the collapsible bladder. In the anticipated play pattern, the plunger is caused to be forced against the bladder by forcing the plunger into the housing cavity and collapsing the bladder. The collapsing of the bladder results in a pressurized airflow into the inflatable member.

While the foregoing described prior art devices have provided some level of amusement and play value through their use of inflatable toys and inflation devices, there remains a continuing need in the art for evermore creative and interesting inflation type toys.

SUMMARY OF THE INVENTION

Accordingly, it is a general object of the present invention to provide an improved inflation toy. It is a more particular object of the present invention to provide an improved inflation toy which may be easily handled by young children and which provides an exciting play pattern.

In accordance with the present invention, there is provided for use in combination with an elastic material formed into a generally pancake-like shape, an inflator toy comprises: a housing defining an interior cavity and a first aperture; a lock ring defining a second aperture therein releasibly attachable to the housing such that the first and second apertures are generally aligned; air pressure means for pressurizing the interior cavity, the lock ring sealingly captivating the elastic material upon the housing overlapping the first aperture such that a portion of the elastic material is bulged outwardly through the second apertures as the air pressure means are operated.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
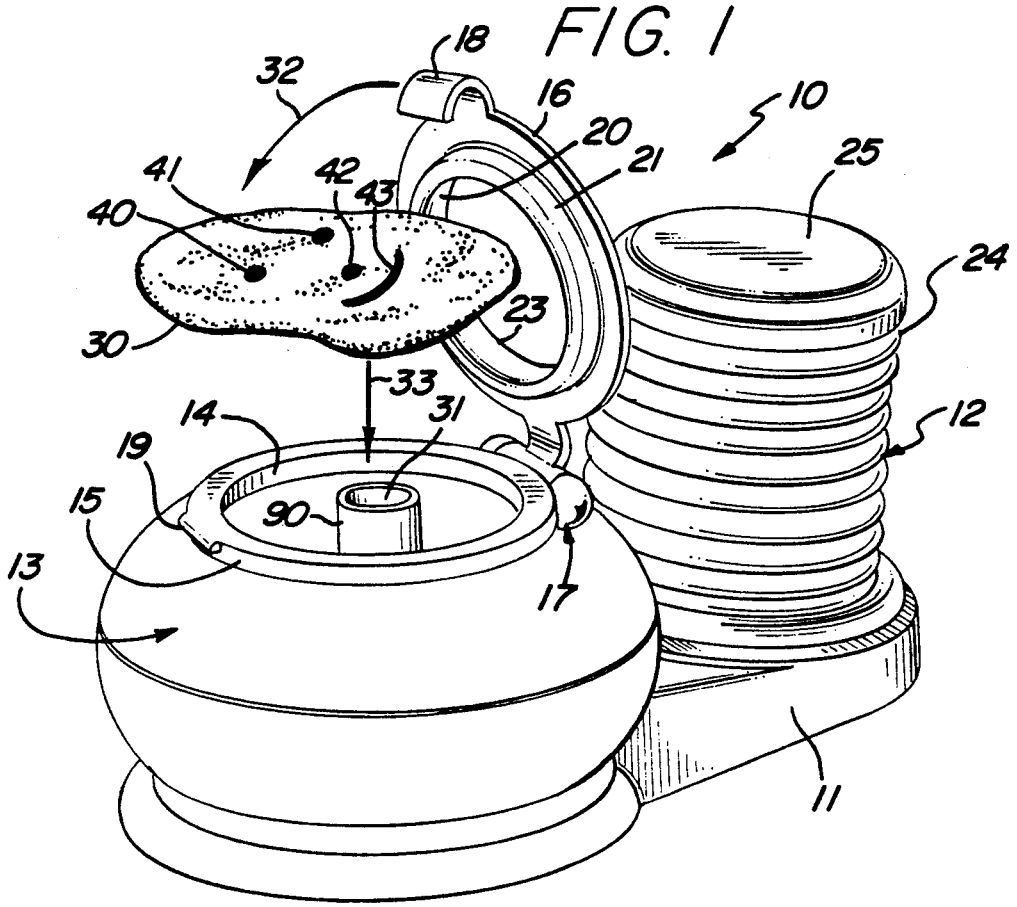
FIG. 1 sets forth a perspective view of an elastic material inflation toy constructed in accordance with the present invention in the open position.

FIG. 1 sets forth a perspective view of an elastic material inflation toy constructed in accordance with the present invention and generally referenced by numeral 10. Inflation toy 10 includes an elongated generally hollow base member 11 which in turn supports an upwardly extending air bellows 12. Base member 11 further defines a generally spherically shaped housing 13 having an interior cavity 22 defined therein. Spherical housing 13 further defines an upwardly extending annular collar 15 having an aperture 14 extending therethrough. Collar 15 further includes an outwardly extending lock tab 19.

An annular lock ring 16 is coupled to collar 15 in a pivotal attachment at a hinge mechanism 17. Lock ring 16 further includes a downwardly extending material sealing collar 21 defining an aperture 20 therethrough. Lock ring 16 further defines an upwardly extending throat extension 23 (better seen in FIG. 2). Aperture 20 extends continuously from sealing collar 21 through throat extension 23.

Air bellows 12 is constructed in accordance with conventional fabrication techniques and is preferably formed of a resilient plastic material or the like. Air bellows 12 includes a plurality of collapsible accordion-like folds 24 and a closed end surface 25. The bottom portion of air bellows 12 is sealingly secured to base member 11 by conventional attachment means which are better seen in FIG. 3. By means set forth below in greater detail, a generally cylindrical L-shaped inflator tube 90 is coupled to air bellows 12 and extends upwardly through aperture 14. Inflator tube 90 is better seen in FIG. 3. However, suffice it to note here that inflator tube 90 defines an interior passage 31 extending therethrough.

In the open position shown in FIG. 1, lock ring 16 has been released from collar 15 and pivoted about hinge 17 to the generally vertical position shown. When so positioned and in accordance with an important aspect of the present invention, a quantity of elastic easily deformable material 30 is manipulated to form a pancake-like shape and thereafter is placed upon collar 15 in the direction indicated by arrow 33. In the preferred use of the present invention elastic material inflation toy, elastic material 30 is formed to have sufficient width so as to span collar 15 in its entirety and preferably extend a short distance beyond. Once elastic material 30 has been placed upon collar 15, lock ring 16 is pivoted downwardly about hinge 17 forcing material sealing collar 21 into aperture 14 and captivating elastic material 30. In its preferred form, elastic material 30 is sufficiently deformable to permit material sealing collar 21 to be embedded into material 30. Lock ring 16 is forced downwardly in the direction of arrow 32 until lock clasp is received upon and engages lock tab 19 which results in curing lock ring 16 in the closed position.

Figure 2:
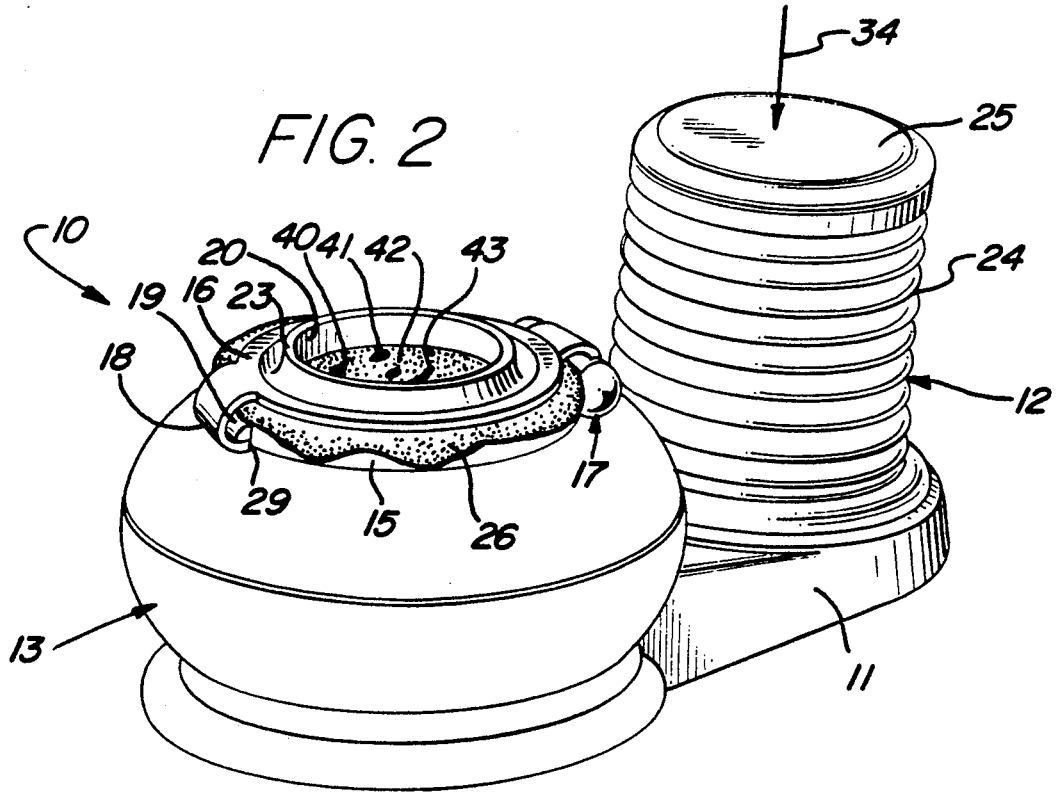
FIG. 2 sets forth a perspective view of the present invention elastic material inflation toy in the closed position.

FIG. 2 sets forth the present invention elastic material inflation toy following the above-described operation in which a quantity of elastic material 30 has been placed upon collar 15 and secured thereto by lock ring 16 and lock clasp 18 as described above. Thus, with lock ring 16 firmly secured in the closed position captivating elastic material 30, material sealing collar 21 is forced into and slightly deforms material 30 within aperture 14 (seen in FIG. 1). Lock clasp 18 is preferably formed of a somewhat resilient material and defines a gripping edge 29 extending inwardly a sufficient distance to engage lock tab 19 when clasp 18 is forced over tab 19 to the locked position shown in FIG. 2.

The captivation of elastic material 30 is best maintained if elastic material 30 is formed as described above to have a width slightly greater than the outer width of collar 15. When so formed following the above-described closure action to the locked position shown in FIG. 2, an excess quantity of material 26 is seen to be generally disposed about the outer portion of collar 15 and lock ring 16. This excess material helps to maintain the secure attachment of elastic material 30 between collar 15 and lock ring 16.

In operation once the elastic material has been secured, the user forces end surface 25 of air bellows downwardly in the direction indicated by arrow 34 to collapse air bellows 12 and produce a stream of pressurized air which by means set forth below in greater detail is transferred to the interior of spherical housing 13. The air transfer mechanism by which air bellows 12 is coupled to the interior of housing 13 is set forth below in FIG. 3 in greater detail. However, suffice it to state here that suitable check valve combinations are provided which enable the user to repeatedly compress and release air bellows 12 causing successive bursts of compressed air to be forced into spherical housing 13. As the air pressure within spherical housing 13 is increased through the manipulation of air bellows 12, the pressure upon the undersurface of elastic material 30 in the area spanning aperture 14 of collar 15 (seen in FIG. 1) begins to overcome the elastic force of material 30 and material 30 is bulged upwardly through aperture 20 forming a convex surface. Thereafter, the continued operation of air bellows 12 further pressurizes housing 13 which in turn forces elastic material 30 upwardly through aperture 20 to ultimately form an inflated generally spherical bubble such as that shown in FIG. 3. In the anticipated play pattern for the present invention elastic material inflation toy, the manipulation of air bellows 12 continues until the inflated portion of elastic material 30 bursts. Thereafter, elastic material 30 may be recycled by releasing clasp 18 and pivoting lock ring 16 to the generally vertical open position shown in FIG. 1 and thereafter removing the remnants of elastic material 30 from collar 14, housing 13 and lock ring 16 and manipulating and kneading elastic material 30 back into a second pancake-like shape afterwhich the above-described process may be repeated.

In accordance with an additional play option on the part of the user, a symbol such as a face formed by elements 40, 41, 42 and 43 may be drawn by the user upon elastic material 30 using an appropriate marker or the like. When so marked, the expansion of elastic material 30 into the balloon-like sphere shown in FIG. 3 causes a corresponding expansion of the symbol or pattern disposed upon the surface of elastic material 30. This, in turn, produces an additional amusement characteristic for the present invention elastic material inflation toy.

Figure 3:
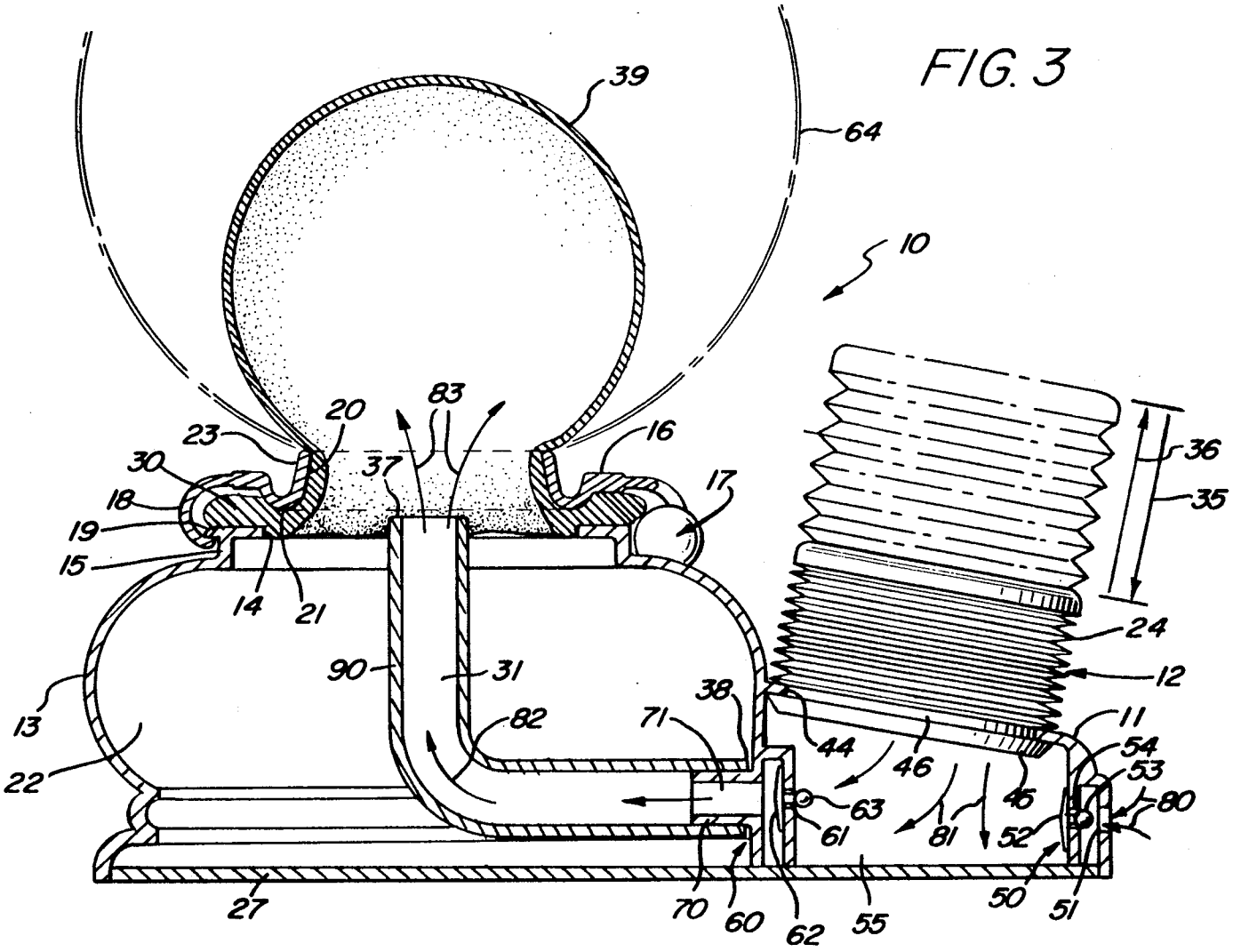
FIG. 3 sets forth a section view of the present invention elastic material inflation toy taken along section lines 3—3 in FIG. 2.

FIG. 3 sets forth a section view of elastic material inflation toy 10 taken along section lines 3—3 in FIG. 2. As described above, elastic material inflation toy 10 includes an elongated base member 11 having a spherical housing 13 defined therein. Spherical housing 13 defines an upwardly extending collar 15 having an aperture 14 defined therein. Collar 15 further includes an outwardly extending lock tab 19. A generally planar bottom surface 27 extends beneath base member 11 and spherical housing 13 forming an air-tight sealed interior cavity 22 within spherical housing 13. Base member 11 further defines a circular aperture 44 and a pair of apertures 51 and 54. A one-way valve 50 is supported within base member 11 and includes a diaphragm 52 supported Within chamber 55 and secured by a resilient retainer 53. A second one-way valve 60 includes a diaphragm having a resilient retainer 63. A fitting 70 is interposed between chamber 55 and interior cavity 22 and includes a generally cylindrical extension having a passage 71 therethrough. Fitting 70 further includes an aperture 61 which receives retainer 63 of diaphragm 62.

An L-shaped inflator tube 90 having a generally circular cross-section defines an interior passage 31 and an upwardly extending end portion 37. Inflator tube 90 further defines an end portion 38 which is received upon fitting 70 in a generally sealing attachment. Inflator tube 90 further defines a passage 31 which extends between ends 38 and 37.

An annular lock ring 16 includes an upwardly extending throat extension 23 and a downwardly extending seal collar 21. An aperture 20 is formed within lock ring 16 and extends between seal collar 21 and throat extension 23. Lock ring 16 further defines a resilient semicircular lock clasp 18 which in the closed position shown in FIG. 3 is received upon and engages lock tab 19 of collar 15 In accordance with the present invention, a quantity or elastic material 30 is received upon collar 15 and captivated between collar 15 and lock ring 16 in the above-described attachment process.

In operation and with temporary reference to FIG. 2, the above-described play pattern has been carried forward to deposit a pancake-like quantity of elastic material 30 upon collar 15 and to secure the deposited elastic material by closing lock ring 16 and locking clasp 18 upon lock tab 19. Thus, with elastic material 30 and inflation toy 10 configured in the position shown in FIG. 2, the above-described play process is instituted in which air bellows 12 is repeatedly compressed and released.

Returning to FIG. 3, the successive compression and release of air bellows 12 in the directions indicated by arrows 35 and 36 provide a stream high pressure air which is used to inflate a portion of elastic material 30.

Specifically, as air bellows 12 is driven downwardly or compressed in the direction indicated by arrow 35, an increased air pressure is created within chamber 55. The increased air pressure within chamber 55 forces diaphragm 52 of one-way valve 50 tightly against aperture 54 and provides a sealing of aperture 54. Conversely, the increased pressure within chamber 55 provides an air pressure force against diaphragm 62 urging it away from aperture 61 and opening one-way valve 60. As one-way valve 60 is opened, a portion of the compressed air within chamber 55 flows outwardly through aperture 61 and enters passage 71 in the direction indicated by arrow 82. As the pressure within chamber 55 remains, pressurized air flows outwardly through passage 31 of inflator tube 90 and exits tube 90 at end 37 in the manner indicated by arrows 83. Thereafter, when air bellows 12 is released, the resiliency of compressible folds 24 causes air bellows 12 to expand upwardly in the direction indicated by arrow 36. The expansion of air bellows 12 causes a reduced air pressure within chamber 55 which draws diaphragm 62 of one-way valve 60 tightly against aperture 61 providing a seal thereof. Concurrently, the reduced air pressure within chamber 55 draws diaphragm 52 away from aperture 54 thereby opening aperture 54 and permitting an inward flow of air in the direction indicated by arrows 80 which fills chamber 55. The cycle is repeated by forcing air bellows downwardly in the direction indicated by arrow 35 carrying forward the above-described cycle in response to pressurized air within chamber 55 and producing additional air flow and air pressure within interior cavity 22 of spherical housing 13.

Thus, as air bellows 12 is repeatedly operated through successive cycles of compression and expansion, the cooperating action of one-way valves 50 and 60 facilitate the pressurizing of spherical housing 13. As interior cavity 22 of spherical housing 13 is further pressurized, a point is reached in which the elastic force of the portion of material 30 spanning aperture 14 of collar 15 is exceeded by the force of pressurized air against it and elastic material 30 begins to expand upwardly through aperture 20 of throat extension 23. With continued manipulation of air bellows 12, a spherical expansion 39 is formed of elastic material 30 and is supported by pressurized air within its interior. As air bellows 12 is further operated, the pressure within interior cavity 22 and spherical expansion 39 is further increased causing a corresponding increased expansion of elastic material 30 such as that shown by material expansion 64. At some point in the process, the pressure within the expanding elastic material exceeds the strength of the material and the spherical expansion then bursts.

Once the spherical expansion of material has burst, the play pattern may be resumed by simply releasing lock clasp 18 from tab 19 and pivoting lock ring 16 to its open generally vertical position such as that shown in FIG. 1. Thereafter, the remnants of elastic material may be collected and removed from collar 15 and lock ring 16 to be again formed into an elastic material pancake which facilitates the repeating of the play cycle.

It will be apparent to those skilled in the art that the above-described process itself is extremely entertaining for young children. It will be further apparent, however, that additional play patterns may be imagined and created which make use of this novel elastic material inflation toy.

Thus, what has been shown is a new and unusual elastic material inflation toy which utilizes an elastic formable material to provide a virtually endless succession of play cycles in which the elastic material is inflated into spherical expansion or "bubbles" of significant size. The elastic material may be repeatedly used and thus provides virtually endless play and amusement.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An inflator toy comprising:

a quantity of moldable elastic material formable into a generally flat member;

a housing defining a first aperture and interior cavity;

an openable securing means defining a second aperture and being movable between an open position and a closed position for sealingly securing a portion of said elastic moldable material across said first and second apertures in said closed position; and air pressure means for pressurizing said interior cavity causing the portion of said elastic formable material spanning said first and second apertures to bulge and inflate, said elastic material being removable from said openable securing means in said open position and reformable into a generally flat member and returned to said openable securing means and forming a renewed portion sealingly secured across said first and second apertures upon movement of said securing means to said closed position.

2. An inflator toy comprising:

a quantity of moldable elastic material formed into a generally pancake-like shape;

a housing defining an interior cavity and a first aperture;

a lock ring defining a second aperture therein;

means for releasibly attaching said lock ring to said housing such that said first and second apertures are generally aligned and said elastic material is sealingly captivated therebetween; and air pressure means attached to said housing and communicating with said cavity for pressurizing said interior cavity and bulging and pressurizing said elastic material outwardly through said second aperture causing a portion of said moldable elastic material to deform and burst, said elastic material being removable from said lock ring and remoldable into a generally pancake-like shape having a burst-free portion larger than said first aperture and returned to sealing captivation between said first and second apertures.

3. An inflator toy as set forth in claim 1 wherein said housing includes an upwardly extending collar encircling said first aperture.

4. An inflator toy as set forth in claim 3 wherein said collar and said lock ring include cooperating hinge means for pivotally attaching said lock ring to said housing, said lock ring being pivotable between an open position away from said collar and a closed position proximate to it.

5. An inflator toy as set forth in claim 4 wherein said lock ring and said collar include cooperating lock means for locking said collar in said closed position captivating said elastic material.

6. An inflator toy as set forth in claim 5 wherein said lock ring defines an extending seal collar encircling said second aperture, said seal collar being forced into said elastic material as said lock ring is moved to said closed position.

7. An inflator toy as set forth in claim 6 wherein said lock ring, said first and second apertures and said seal collar are generally circular and wherein said seal collar is smaller in diameter than said first aperture.

8. An inflator toy as set forth in claim 7 wherein said air pressure means include a collapsible air bellows and a pair of oppositely oriented one-way air valves.

9. An inflator toy as set forth in claim 3 wherein said lock ring and said collar include cooperating lock means for locking said collar in said closed position captivating said elastic material.

10. An inflator toy as set forth in claim 9 wherein said lock ring defines an extending seal collar encircling said second aperture, said seal collar being forced into said elastic material as said lock ring is moved to said closed position.

11. An inflator toy as set forth in claim 10 wherein said lock ring, said first and second apertures and said seal collar are generally circular and wherein said seal collar is smaller in diameter than said first aperture.

12. An inflator toy as set forth in claim 11 wherein said air pressure means include a collapsible air bellows and a pair of oppositely oriented one-way air valves.

* * * * *